US010938141B2

(12) United States Patent
Kien

(10) Patent No.: US 10,938,141 B2
(45) Date of Patent: Mar. 2, 2021

(54) CHARGER SAFETY COVER

(71) Applicant: Tai Kien, Groton, MA (US)

(72) Inventor: Tai Kien, Groton, MA (US)

( * ) Notice: Subject to any disclaimer, the term of this patent is extended or adjusted under 35 U.S.C. 154(b) by 0 days.

(21) Appl. No.: 16/417,882

(22) Filed: May 21, 2019

(65) Prior Publication Data

US 2020/0373701 A1 Nov. 26, 2020

(51) Int. Cl.
*H01R 13/453* (2006.01)
*H01R 43/26* (2006.01)

(52) U.S. Cl.
CPC ..... *H01R 13/4538* (2013.01); *H01R 43/26* (2013.01)

(58) Field of Classification Search
CPC ..... H01R 13/4538
USPC ..... 439/141, 140
See application file for complete search history.

(56) References Cited

U.S. PATENT DOCUMENTS 1,255,824 A * 2/1918 Shoenberg ..... H01R 13/4538 439/141
2,082,986 A * 6/1937 Staley ..... H01R 13/4538 439/140
3,187,293 A 6/1965 Jacobus
3,202,953 A * 8/1965 Bosworth ..... H01R 13/4538 439/140
3,390,371 A 6/1968 Kramer
3,491,326 A * 1/1970 Pfister ..... H01R 13/4538 439/141
3,571,782 A 3/1971 Colbert
3,575,684 A 4/1971 McIntyre
3,683,315 A * 8/1972 Kelly ..... 439/141
3,926,494 A * 12/1975 Maillaro ..... H01R 13/4538 439/131
4,944,685 A 7/1990 Schulte
5,030,119 A * 7/1991 Lowe ..... H01R 13/4538 439/136
5,267,878 A 12/1993 Shinji
5,518,411 A 5/1996 Belleci
5,573,420 A 11/1996 Grosswendt
6,231,358 B1 * 5/2001 Kerr, Jr. ..... H01R 24/66 439/140
6,602,088 B1 * 8/2003 Zhu ..... H01R 13/6593 439/382
6,612,853 B2 * 9/2003 Wu ..... G06K 19/077 439/136
6,672,894 B2 1/2004 Sprunger
6,866,527 B2 * 3/2005 Potega ..... H01R 24/58 439/218
7,070,458 B2 7/2006 Axenbock
(Continued)

FOREIGN PATENT DOCUMENTS

CN 202737267 U 2/2013
CN 202799070 U 3/2013
(Continued)

*Primary Examiner* — Neil Abrams
(74) *Attorney, Agent, or Firm* — Lambert Shortell & Connaughton; David J. Connaughton, Jr.; Gary E. Lambert

(57) ABSTRACT

A safety cover for an electrical charger is provided. The cover is formed of an outer body with a retractable sheath being movable inwardly and outwardly relative to the outer body. The safety cover for the electrical charger is structured and designed so as to limit accidental electrocution dangers caused by the exposed charger plug.

14 Claims, 4 Drawing Sheets

(56) References Cited

U.S. PATENT DOCUMENTS

| | | | | |
|---|---|---|---|---|
| 7,153,148 | B2 * | 12/2006 | Chen | H01R 13/4538 439/141 |
| 7,334,731 | B1 * | 2/2008 | McLean | G06K 19/07 235/441 |
| 7,568,942 | B1 * | 8/2009 | Lannon | H01R 13/5213 439/136 |
| 7,695,294 | B2 * | 4/2010 | Lu | H01R 13/4538 439/136 |
| 8,435,067 | B2 | 5/2013 | Wegener | |
| 8,979,598 | B2 | 3/2015 | Liao | |
| 9,331,466 | B2 | 5/2016 | Scherpenberg | |
| 9,362,674 | B1 | 6/2016 | Don | |
| 9,444,169 | B2 | 9/2016 | Gates | |
| 9,735,494 | B2 * | 8/2017 | Herring | H01R 13/717 |
| 9,761,993 | B2 * | 9/2017 | Larkin | H01R 4/023 |
| 9,923,308 | B2 * | 3/2018 | Holland | H01R 24/525 |
| 10,058,003 | B1 * | 8/2018 | Wang | H05K 7/1427 |
| 10,551,570 | B2 * | 2/2020 | Yodogawa | G02B 6/4214 |
| 2004/0212966 | A1 * | 10/2004 | Fisher | G06K 19/07732 361/726 |
| 2013/0115791 | A1 | 5/2013 | Farahani | |
| 2015/0176162 | A1 | 6/2015 | Relats Manent | |
| 2015/0340809 | A1 | 11/2015 | Lin | |
| 2020/0373701 | A1 * | 11/2020 | Kien | H01R 13/4538 |

FOREIGN PATENT DOCUMENTS

| | | | |
|---|---|---|---|
| CN | 203218587 | U | 9/2013 |
| WO | 2006016119 | A3 | 2/2006 |

* cited by examiner

CHARGER SAFETY COVER

BACKGROUND OF THE INVENTION

Field of the Invention

The present invention relates generally to electrical protective devices. More particularly the present invention relates to a retractable safety cover for an electrical charger.

Description of Related Art

Cell phones are a useful and ubiquitous technology. However, there is a great danger posed to young children by the proliferation of the exposed electrical contacts of plugs of chargers used to charge the batteries of cellphones (as well as other electronics, as they become more and more ubiquitous in our society).

Often in the media one hears reports of small children who have been severely injured or killed by putting a mobile phone charger plug in their mouth while the charger was plugged into an electrical socket. Thus, cellular phone chargers and other chargers pose a fatal risk to children and even adults in some cases. With the proliferation of cell phones and related electronic technology, there is a similar increase in the danger of a child or adult accidentally being electrocuted by their chargers.

Therefore, what is needed is a device that may protect an unsuspecting victim from being injured by electric shock by a charger connected to an electrical socket.

SUMMARY OF THE INVENTION

The subject matter of this application may involve, in some cases, interrelated products, alternative solutions to a particular problem, and/or a plurality of different uses of a single system or article.

In one aspect, a safety cover for an electrical charger is provided. The cover is formed of an outer body with a retractable sheath being movable inwardly and outwardly relative to the outer body. The retractable sheath has a central opening through which a charger plug can pass, and is movable with respect to the charger plug. On an opposite side of the outer body from the sheath is a cord protector operable to relieve strain on a cord extending away from the outer body.

In another aspect, a safety cover for an electrical charger is provided. The cover is formed of an outer body with a retractable sheath being movable inwardly and outwardly relative to the outer body. The retractable sheath has a central opening through which a charger plug can pass, and is movable with respect to the charger plug. The charger plug is engaged with the safety cover, and can be exposed when the retractable sheath is moved to a charging position, and at least partially covered by the sheath when the sheath is in a covering position. On an opposite side of the outer body from the sheath is a cord protector operable to relieve strain on a cord extending away from the outer body.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns an electrical charging cable safety cover which is operable to cover a plug of an electronics charger in a covering mode, and then retract to allow access to the plug when in a charging mode. In most embodiment the cable safety cover uses a retractable sheath which can slide back and forth to cover and expose the charger plug. Further, the retractable sheath, in many embodiments, may be spring loaded (or otherwise biased to a covering position) such that it can automatically extend over the charger plug, and when charging is desired, can be urged against the device, automatically pushing the sheath back as the charger plug connects to the device to be charged. While the charger disclosed herein is typically discussed with respect to the charging of mobile phones, it should be understand that the charging cable safety cover may be used for any electrical connector. In particular, the present invention may be used with any portable electronic device which requires charging and has a charging connector into which a charger can be plugged.

In some embodiments, the charging cable safety cover also has a reinforced strain relief cable protector extending over a portion of an electrical cable which connects the charger to the wall outlet. This protects the cord-charger connection from strain and damage. The strain relief component may be any structure operable to protect the cord, though in many embodiments it is embodied as a reinforced plastic layer covering around a portion of the cord. This covering may have a series of flanges, ridges, and the like, to protect the cord and relieve strain applied to the cord and also resist sharp angling of the cord which causes damage.

Figure 3:
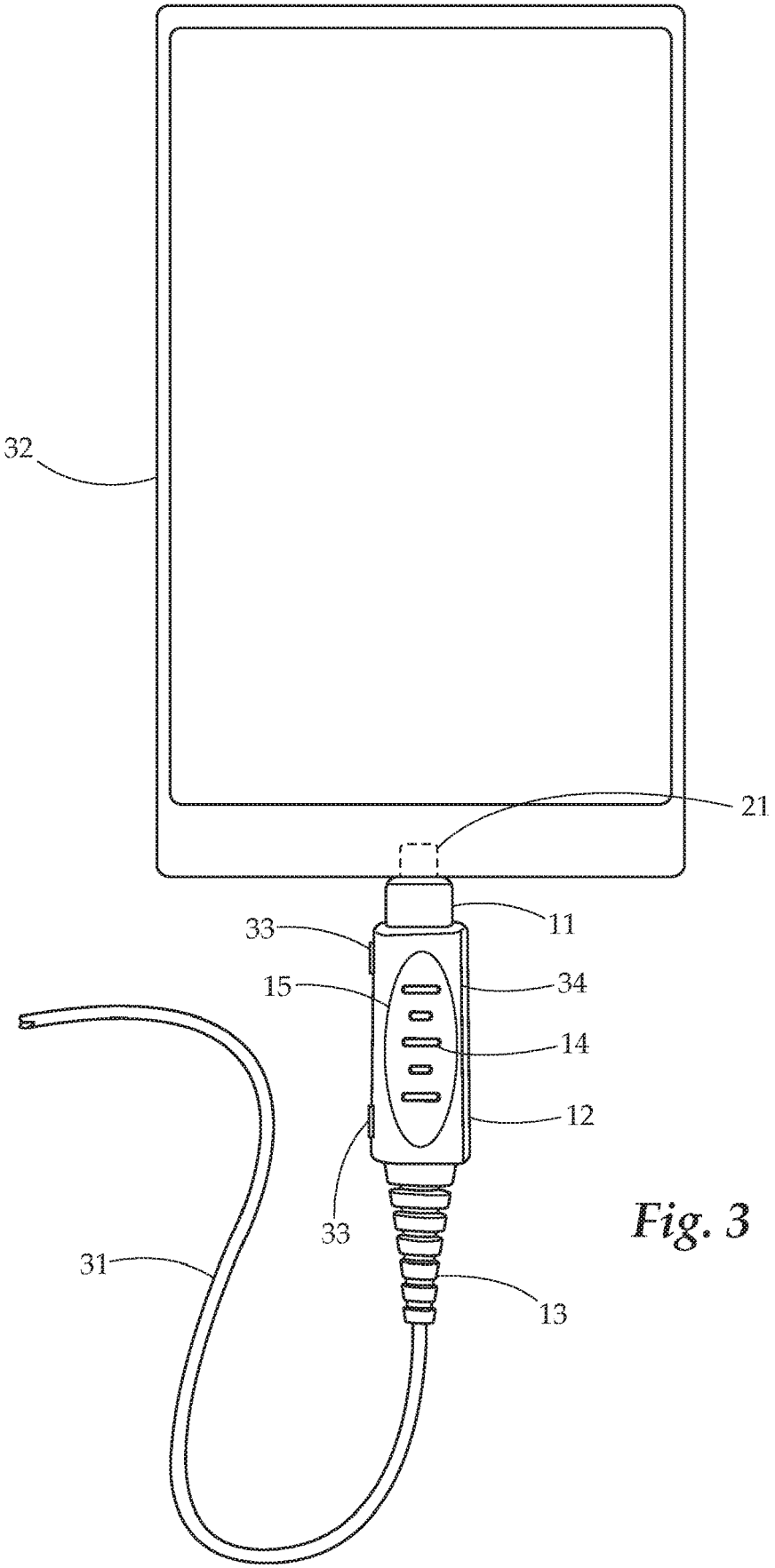
FIG. 3 provides a perspective view of an embodiment of the invention being used to charge an electronic device.

The charging cable safety cover may be removably connectable to an existing charger in one embodiment, or may be permanently connected and built into the charger in another embodiment. In one embodiment of removable connection, the connector may be split along its length, allowing for two pieces to be connected over an existing cable. In still another embodiment, the charging cable safety cover may have a clamshell design allowing it to be removably connected to an existing charging cable by a hinged connection enveloping the charging cable plug. As shown in FIG. 3, the clamshell design uses hinges 33 to allow the cover to be opened and closed about the existing charging cable and plug. Slit 34 shows where the cover opens.

In varying embodiment, components of the charging cable safety cover may be formed of any electrically insulating material. Typically the components are formed of plastic due to the ease of construction, flexibility, and lack of electrical conductivity. It should be understood however, that the charging cable safety cover may be made of any material without straying from the scope of the present invention.

Figure 1:
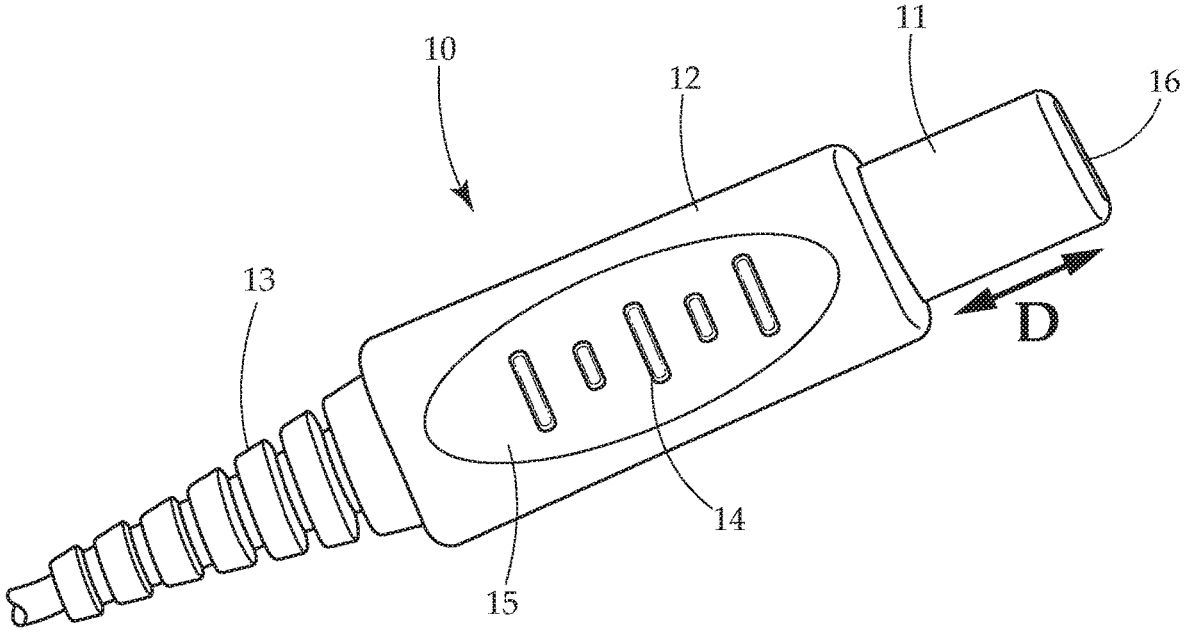
FIG. 1 provides a perspective view of an embodiment of the invention.
Figure 2:
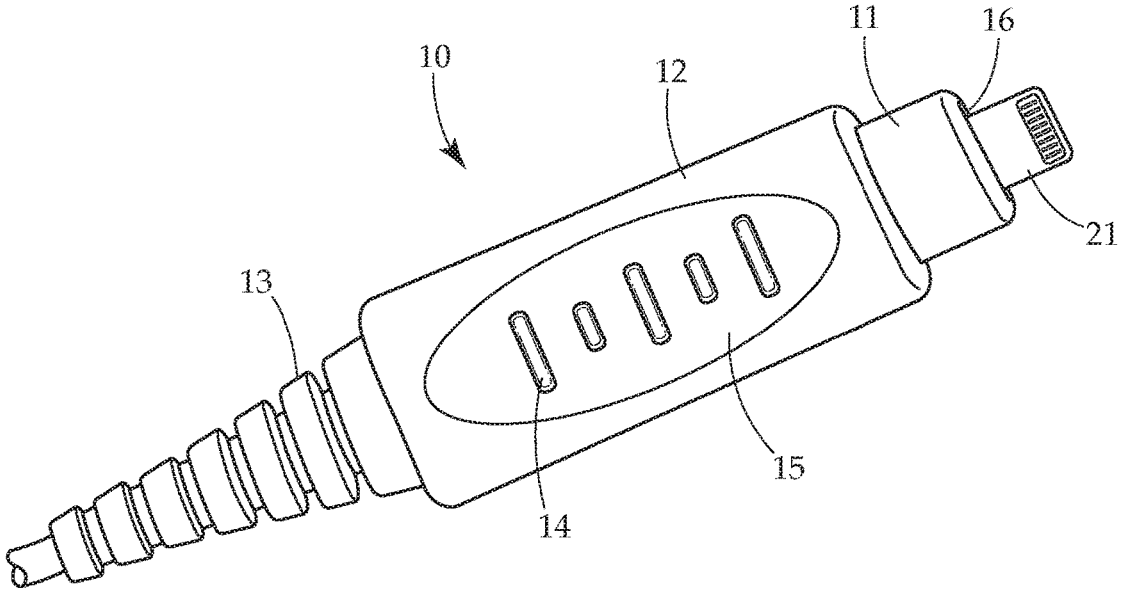
FIG. 2 provides another perspective view of an embodiment of the invention.
Figure 7:
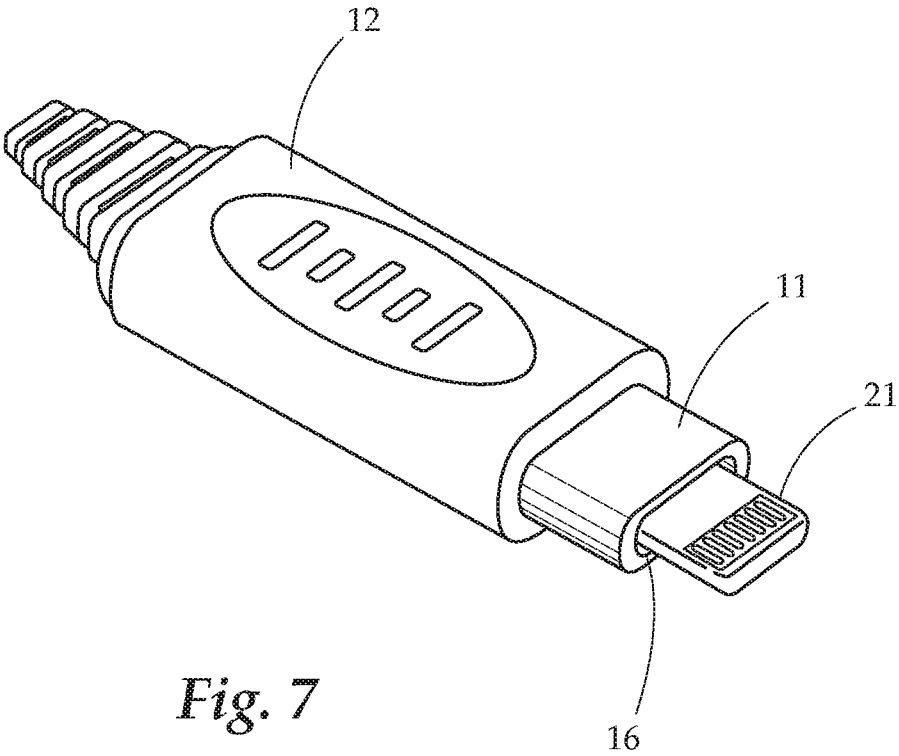
FIG. 7 provides a front perspective view of an embodiment of the present invention.

Turning now to FIGS. 1 and 2, a perspective view of an embodiment of the present invention having the sheath in a covering and charging position, respectively. The charging cable safety cover 10 is formed of an outer body 12 which allows a user to hold and manipulate the charger. On the outer body 12, in this embodiment, are a plurality of finger grip ridges 14 as well as an inwardly curved finger depression 15. Sheath 11 has a central opening 16 to access the charger plug. Sheath 11 can move inwardly and outwardly in direction D relative to the outer body 12, moving into the outer body 12 during the inward movement, as seen in FIG. 2, to expose the charger plug 21. At a distal end of the outer body 12 opposite to the sheath 11 is a flexible cord protector 13 which relieves tension applied to the cord and limits it from being pulled at sharp angles to damage the cord and connection to the charger plug 21. The sheath 11 is biased to extend to the covering position (FIG. 1) when at rest. As such, when the charging cable safety cover 10 is at rest and in a non-operable state, it will be in the covering position with the sheath 11 extended over and covering the charger plug 21. The sheath 11 can be pushed backwards in direction D to expose the charger plug 21. FIG. 7 shows a front perspective view of the present invention, showing the central opening 16 providing access to the charger plug 21.

FIG. 3 shows a view of the invention used charging a phone. As can be seen, the sheath 11 is retracted and abutting the phone 32, while the charger plug 21 is mated with the phone's charging connector. A cord 31 extends away from the body 12 and is supported against damage by cord protector 13.

Figure 4:
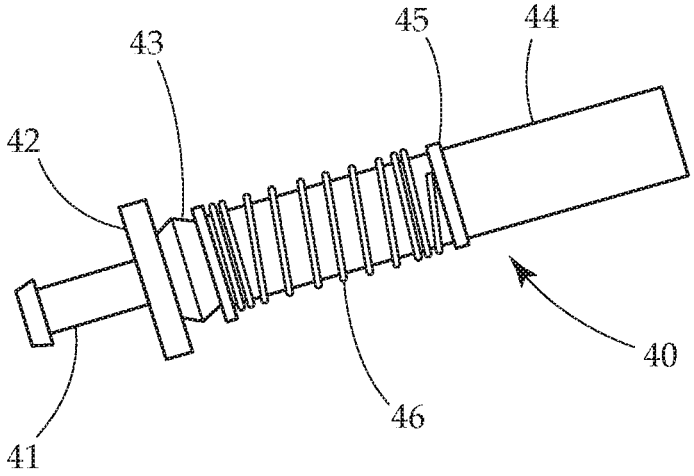
FIG. 4 provides a perspective view of internal components of another embodiment of the present invention.

FIG. 4 provides a view of internal components of the charging cable safety cover. An inner body 40 has an annular flange 42 and a stem 41 at a distal end. The stem 41 allows for connection to the cable protector 13 which abuts flange 42 when connected. The stem also may provide additional support for a cord which may pass through it, supporting the cord against pulling motions and sharp angling at the connection to the plug 21. Two annular ridges 43, 45 extend from the inner body 40. These ridges 43, 45 hold a spring 46 in place over the inner body 40. A proximal end 44 of the inner body 40 is shaped to receive and hold the charger plug 21.

Figure 5:
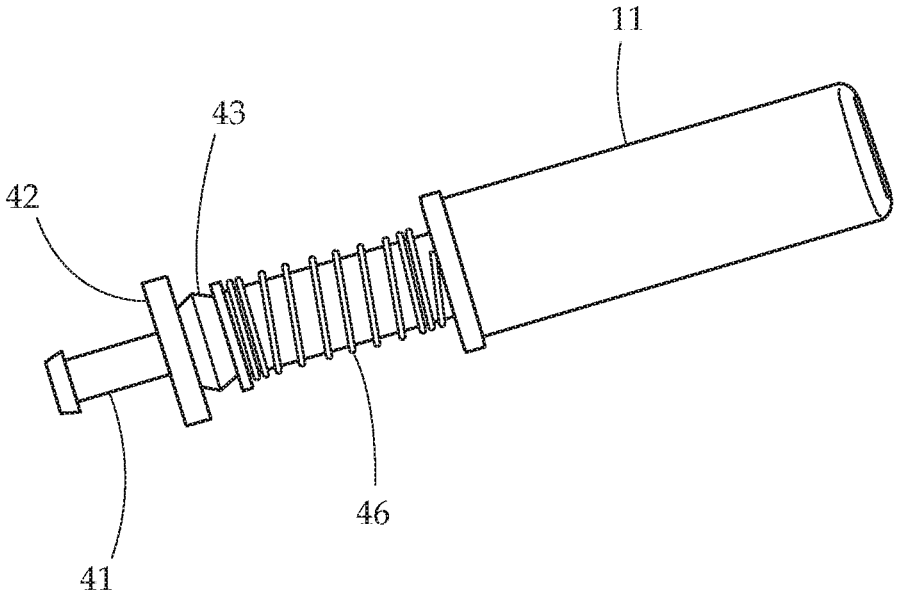
FIG. 5 provides a perspective view of internal components of an embodiment of the present invention.

FIG. 5 provides a view of additional internal components of the charging cable safety cover. Here, the sheath 11 can be seen connected to the inner body 40. The sheath 11 is engaged with spring 46 and is urged towards the proximal end 44 of the inner body 40. The sheath 11 is slideable along the inner body 40 and is limited in its forward and rearward movement by the annular ridges 45 and 43 respectively, with ridge 45 not shown because it is covered by the sheath 11.

Figure 6:
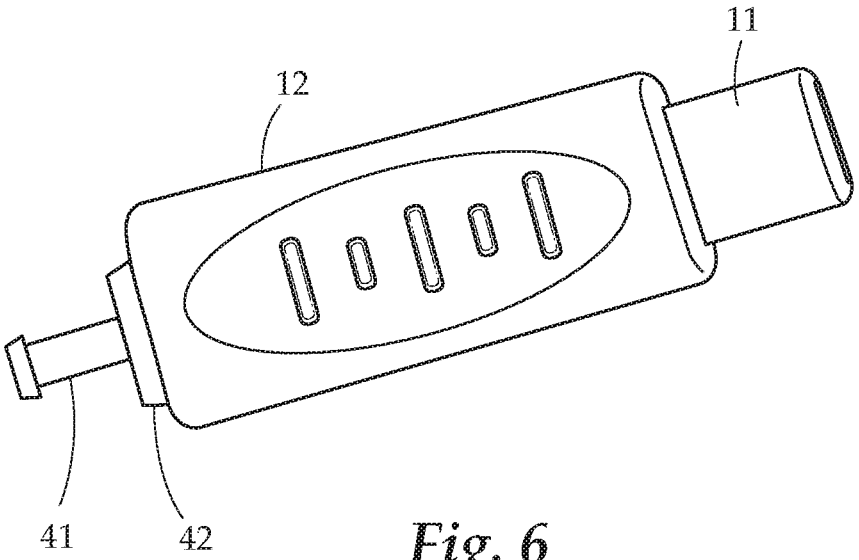
FIG. 6 provides a perspective view of internal components of a further embodiment of the present invention.

FIG. 6 provides a view of additional internal and external components of the charging cable safety cover. Here, outer body 12 is attached to the inner body 40, covering most of the inner body 40 and much of the sheath 11. Outer body 12 abuts flange 42, with the opposite side of the flange 42 and stem 41 of the inner body 40 are still visible. When fully constructed, in this embodiment, the cord protector 13 covers the stem 41 and abuts flange 42.

While several variations of the present invention have been illustrated by way of example in preferred or particular embodiments, it is apparent that further embodiments could be developed within the spirit and scope of the present invention, or the inventive concept thereof. For example, while the disclosed figures are shown applied to an iPhone® charger, it should be understood that the invention is not necessarily limited to any particular charger type. However, it is to be expressly understood that such modifications and adaptations are within the spirit and scope of the present invention, and are inclusive, but not limited to the following appended claims as set forth.

What is claimed is:

1. A safety cover for an electrical charger comprising:

an outer body;

a retractable sheath configured to extend over a charger plug in a covering position, the retractable sheath being movable inwardly and outwardly relative to the outer body, the retractable sheath having a central opening through which the charger plug can pass, the retractable sheath movable with respect to the charger plug; and a cord protector on an opposite side of the outer body from the retractable sheath; and an inner body, the retractable sheath slidably connected to the inner body, the inner body at least partially covered by the outer body; and a spring engaged with the inner body and the retractable sheath; and wherein the inner body comprises a front annular ridge, and the retractable sheath being limited in an outward motion by the front annular ridge.

2. The safety cover for an electrical charger of claim 1 wherein the inner body further comprises a rear annular ridge, the spring held in place by the front and rear annular ridge, and the retractable sheath being limited in inward motion by the rear annular ridge.

3. The safety cover for an electrical charger of claim 1 where the inner body further comprises a flange, the outer body abutting the flange.

4. The safety cover for an electrical charger of claim 1 wherein the outer body is removable from an existing charger plug.

5. The safety cover for an electrical charger of claim 1 wherein the outer body further comprises a plurality of finger ridges.

6. The safety cover for an electrical charger of claim 1 wherein the outer body further comprises a finger depression formed as an inward sloping face of the outer body.

7. A method of operating the safety cover of claim 1 comprising the steps of: urging the sheath of the connector against an area adjacent to a charger connector of a portable electronic device, the urging causing the sheath to move inwardly into the outer body and causing the plug to be urged into the charger connector.

8. A safety cover for an electrical charger comprising:

an outer body;

a retractable sheath configured to extend over a charger plug in a covering position, the retractable sheath being movable inwardly and outwardly relative to the outer body, the retractable sheath having a central opening through which the charger plug passes, the retractable sheath movable with respect to the charger plug;

a charger plug engaged with the safety cover, the charger plug being exposed when the retractable sheath is moved to a charging position, and at least partially covered by the sheath when the sheath is in a covering position; and a cord protector on an opposite side of the outer body from the retractable sheath; and an inner body, the retractable sheath slidably connected to the inner body, the inner body at least partially covered by the outer body, the charger plug in contact with a distal end of the inner body; and a spring engaged with the inner body and the retractable sheath; and a front annular ridge, and the retractable sheath being limited in outward motion by the front annular ridge.

9. The safety cover for an electrical charger of claim 8 wherein the inner body further comprises a rear annular ridge, the spring held in place by the front and rear annular ridge, and the retractable sheath being limited in inward motion by the rear annular ridge.

10. The safety cover for an electrical charger of claim 8 where the inner body further comprises a flange, the outer body abutting the flange.

11. The safety cover for an electrical charger of claim 8 wherein the outer body is removable from an existing charger plug.

12. The safety cover for an electrical charger of claim 8 wherein the outer body further comprises a plurality of finger ridges.

13. The safety cover for an electrical charger of claim 8 wherein the outer body further comprises a finger depression formed as an inward sloping face of the outer body.

14. A method of operating the safety cover of claim 8 comprising the steps of: urging the sheath of the connector against an area adjacent to a charger connector of a portable electronic device, the urging causing the sheath to move inwardly into the outer body and causing the plug to be urged into the charger connector.

* * * * *